US010818266B2

(12) United States Patent
Chaji

(10) Patent No.: US 10,818,266 B2
(45) Date of Patent: Oct. 27, 2020

(54) SYSTEMS AND METHODS OF REDUCED MEMORY BANDWIDTH COMPENSATION

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 16/513,889

(22) Filed: Jul. 17, 2019

(65) Prior Publication Data

US 2020/0013372 A1 Jan. 9, 2020

Related U.S. Application Data

(63) Continuation of application No. 15/927,421, filed on Mar. 21, 2018, now Pat. No. 10,403,230, which is a continuation of application No. 15/165,435, filed on May 26, 2016, now Pat. No. 9,947,293.

(51) Int. Cl.
*G09G 5/02* (2006.01)
*G09G 3/3225* (2016.01)

(52) U.S. Cl.
CPC ..... *G09G 5/026* (2013.01); *G09G 3/3225* (2013.01); *G09G 2320/029* (2013.01); *G09G 2320/0223* (2013.01); *G09G 2320/0285* (2013.01); *G09G 2320/041* (2013.01); *G09G 2320/043* (2013.01); *G09G 2320/045* (2013.01); *G09G 2340/04* (2013.01); *G09G 2350/00* (2013.01)

(58) Field of Classification Search
None
See application file for complete search history.

(56) References Cited

U.S. PATENT DOCUMENTS

2002/0122044 A1* 9/2002 Deering ..... G06F 3/1431 345/597
2012/0075354 A1* 3/2012 Su ..... G09G 5/10 345/690

* cited by examiner

*Primary Examiner* — Ryan M Gray
(74) *Attorney, Agent, or Firm* — Stratford Managers Corporation

(57) ABSTRACT

What is disclosed are systems and methods of compensation of images produced by active matrix light emitting diode device (AMOLED) and other emissive displays. Sub-sampling of pixel measurement data utilized in compensation of the display is utilized to reduce the data bandwidth between memory and a compensation module where the data is locally interpolated.

20 Claims, 4 Drawing Sheets

SYSTEMS AND METHODS OF REDUCED MEMORY BANDWIDTH COMPENSATION

PRIORITY CLAIM

This application is a continuation of U.S. patent application Ser. No. 15/927,421, filed Mar. 21, 2018, now allowed, which is a continuation of U.S. patent application Ser. No. 15/165,435, filed May 26, 2016, now U.S. Pat. No. 9,947,293, which claims priority to Canadian Application No. 2,892,714, filed May 27, 2015, each of which is hereby incorporated by reference in its entirety.

FIELD OF THE INVENTION

The present disclosure relates to image compensation for light emissive visual display technology, and particularly to compensation systems and methods which exhibit reduced memory bandwidth in compensating images produced by active matrix light emitting diode device (AMOLED) and other emissive displays.

BRIEF SUMMARY

According to a first aspect there is provided a method for compensating an image produced by an emissive display system comprising an array of pixels, each pixel including a light-emitting device, the method comprising:

- storing full resolution measurement data of the entire array of pixels in a memory;
- retrieving measurement data from the memory only for a selected subset of pixels of the display;
- interpolating the measurement data from a selected subset of pixels for generating interpolated measurement data for each pixel of the display; and
- compensating the display using of the interpolated measurement data;
- wherein the selected subset of pixels is predetermined based on minimizing error between the interpolated measurement data and the full resolution measurement data stored in the memory.

In some embodiments, the partial resolution measurement data comprises measurement data only for a selected subset of pixels of the display. In some embodiments measuring characteristics of a plurality of pixels comprises measuring with sub-sampling characteristics only of a selected subset of the pixels of the display system generating measurement data which is said partial resolution measurement data.

In some embodiments, measuring characteristics of a plurality of pixels comprises measuring characteristics of all of the pixels of the display system generating measurement data which comprises full resolution measurement data, and wherein retrieving partial resolution measurement data comprises retrieving with sub-sampling measurement data of only a selected subset of pixels of the display from the full resolution measurement data stored in the memory.

Some embodiments further provide for determining the selected pixels of the display so as to reduce an error between the full resolution interpolated measurement data and the full resolution measurement data.

Some embodiments further provide for, for each pixel of the display other than pixels of said selected subset of pixels of the display: predicting a corresponding interpolated pixel data portion of said full resolution interpolated measurement data; comparing said corresponding interpolated pixel data portion with a corresponding pixel data portion of said full resolution measurement data generating a predicted pixel interpolation error; and for pixels where said predicted pixel interpolation error exceeds a threshold, storing interpolation correction data for said pixel in an error table and performing said generation of said full resolution interpolated measurement data comprises determining absolute measurement data for said pixel with use of said interpolation correction data.

In some embodiments, determining absolute measurement data for said pixel comprises replacing corresponding interpolated pixel data portion of said full resolution interpolated measurement data with said interpolation correction data. In some embodiments, determining absolute measurement data for said pixel comprises replacing corresponding interpolated pixel data portion of said full resolution interpolated measurement data with absolute measurement data generated with use of said interpolation correction data and said corresponding interpolated pixel data portion.

In some embodiments, measuring characteristics of a plurality of pixels generating measurement data comprises generating low spatial frequency measurement data and high spatial frequency measurement data, storing the measurement data in the memory comprises storing the low spatial frequency measurement data and high spatial frequency measurement data in the memory, retrieving partial resolution measurement data from the measurement data stored in the memory comprises retrieving low spatial frequency partial resolution measurement data from the low spatial frequency measurement data stored in the memory and retrieving high spatial frequency partial resolution measurement data from the high spatial frequency measurement data stored in the memory, interpolating the measurement data generating full resolution interpolated measurement data comprises interpolating the low spatial frequency measurement data and interpolating the high spatial frequency measurement data and combining the interpolated low spatial frequency measurement data and the interpolated high spatial frequency measurement data together generating full resolution interpolated measurement data.

In some embodiments, a sub-sampling frequency utilized to generate partial resolution measurement data is settable by at least one of a user and the display system.

According to another aspect, there is provided a system for compensating an image produced by an emissive display system comprising an array of pixels, each pixel including a light-emitting device, the system comprising:

- a display comprising the array of pixels;
- a monitoring system coupled to the array of pixels for measuring characteristics of substantially all of said pixels generating full resolution measurement data;
- a memory for storing the full resolution measurement data;
- an interpolation module capable of retrieving selected measurement data from only a selected subset of pixels of the display stored in the memory, and interpolating the selected measurement data generating interpolated measurement data for each pixel of the display;
- a compensation module for compensating the display with use of the interpolated measurement data for each pixel; and
- a sub-sampling module configured to predetermine the selected subset of pixels based on minimizing error between the interpolated measurement data and the full resolution measurement data stored in the memory.

In some embodiments, the monitoring system is for measuring characteristics of a plurality of pixels which comprises measuring with sub-sampling characteristics only of a selected subset of the pixels of the display system generating measurement data which is said partial resolution measurement data.

In some embodiments, the monitoring system is further for measuring characteristics of all of the pixels of the display system generating measurement data which comprises full resolution measurement data, and wherein the interpolation module is further for retrieving with sub-sampling measurement data of only a selected subset of pixels of the display from the full resolution measurement data stored in the memory.

Some embodiments further provide for a sub-sampling module for determining the selected pixels of the display so as to reduce an error between the full resolution interpolated measurement data and the full resolution measurement data.

In some embodiments, the interpolation module is further for, for each pixel of the display other than pixels of said selected subset of pixels of the display: predicting a corresponding interpolated pixel data portion of said full resolution interpolated measurement data; comparing said corresponding interpolated pixel data portion with a corresponding pixel data portion of said full resolution measurement data generating a predicted pixel interpolation error; and for pixels where said predicted pixel interpolation error exceeds a threshold, for storing interpolation correction data for said pixel in an error table and performing said generation of said full resolution interpolated measurement data comprises determining absolute measurement data for said pixel with use of said interpolation correction data.

In one aspect, the data is spatially sub-sampled (between a group of a few pixels, only the data for one pixel is passed to the compensation module) and an interpolation module in the compensation module creates the data samples for the other pixels in the array.

In another aspect, the data is divided into low spatial frequency and high spatial frequency. The low spatial frequency data is sampled at fewer pixels and the higher spatial frequency content is sampled at more pixels. The interpolation block creates the low frequency and high frequency content and from those data creates the accurate content for each pixel.

In another aspect, the sampled pixel can be dynamically changed to reduce the interpolation error.

In another aspect, an error table stores the data (or delta data) for pixels that interpolation creates an error beyond a threshold. The data from these pixels will be directly fetched from said error table or the data from said error table will be used to fix the error in the interpolated data.

In another aspect, the sub-sampling frequency can be set by a user or the system. In one example, for some content the compensation is not critical and so the sub-sampling frequency can be decreased. In another example, for saving power, the system may decide to reduce the sub-sampling frequency.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
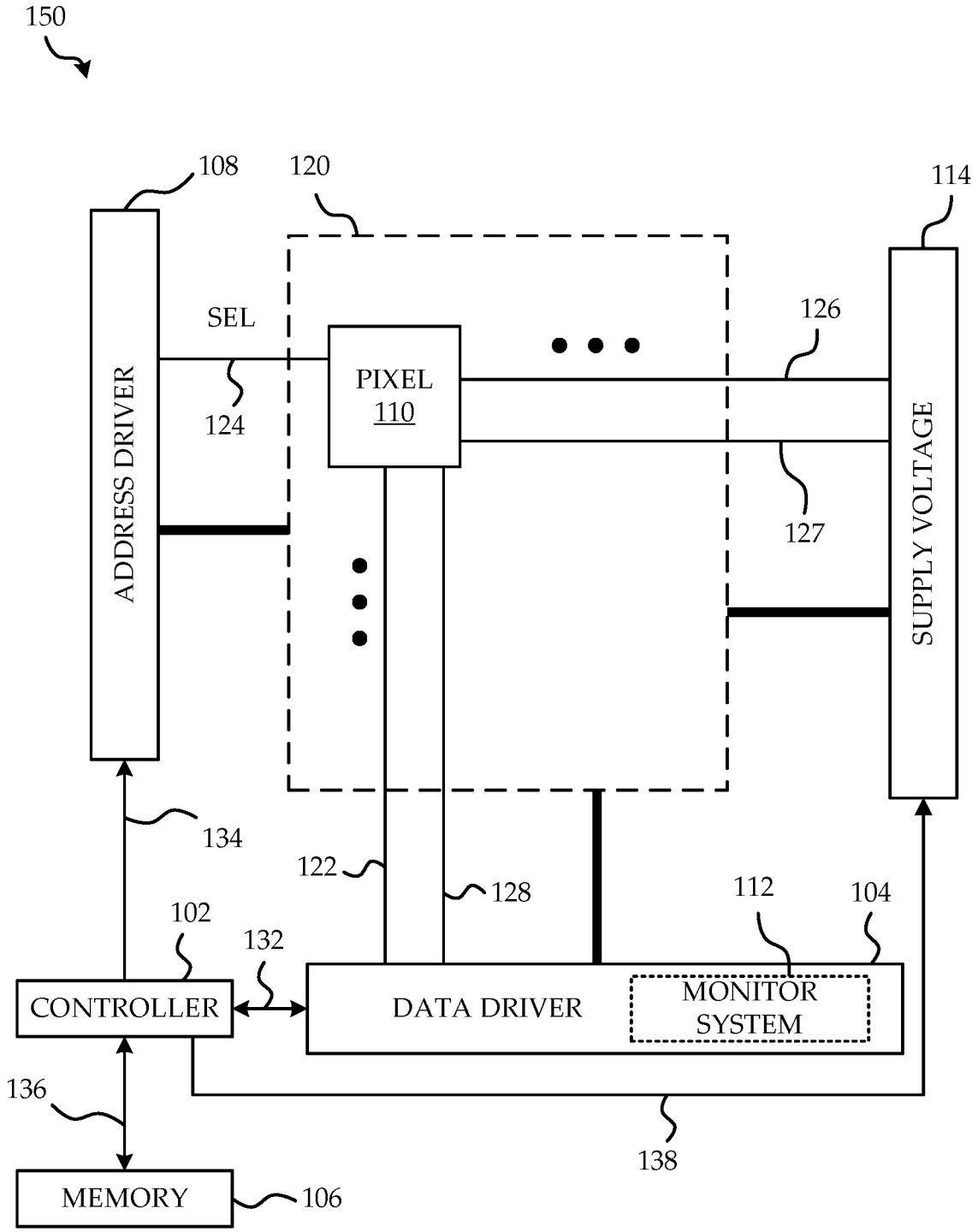
FIG. 1 illustrates an example display system which participates in and whose pixels are to be compensated with use of the compensation systems and methods disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Methods of image calibration and compensation are used to correct for those defects in order to produce images which are more accurate, uniform, or otherwise more closely reproduces the image represented by the image data.

As the resolution and/or frame rate of an array semiconductor device increases, or the number of issues that needed to be compensated/calibrated, the data transfer between memory and compensation module increases dramatically. This can result in higher power consumption, higher manufacturing costs, and a larger physical foot print. The systems and methods disclosed below address these issues through reduction in bandwidth.

While the embodiments described herein will be in the context of AMOLED displays it should be understood that the compensation systems and methods described herein are applicable to any other display comprising pixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods described further below. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 112 can be integrated with the data driver 104, or can be a separate stand-alone system. In particular, the monitoring system 112 can optionally be implemented by monitoring the current and/or voltage of the data line 122 during a monitoring operation of the pixel 110, and the monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiments, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110, the aging information is retrieved from the memory 106 by the controller 102 via memory signals 136, and the controller 102 then compensates for the extracted degradation information in subsequent programming and/or emission operations of the pixel 110. For example, once the degradation information is extracted, the programming information conveyed to the pixel 110 via the data line 122 can be appropriately adjusted during a subsequent programming operation of the pixel 110 such that the pixel 110 emits light with a desired amount of luminance that is independent of the degradation of the pixel 110. In an example, an increase in the threshold voltage of the driving transistor within the pixel 110 can be compensated for by appropriately increasing the programming voltage applied to the pixel 110. Generally, any data utilized for purposes of calibrating or compensating the display for the above mentioned and similar deficiencies will be referred to herein as measurement data.

Monitoring system 112 may extend to external components (not shown) for measuring characteristics of pixels which are utilized in subsequent compensation, and may include photodiodes or optical sensor arrays for directly measuring the luminance output of pixels in response to input data. Generally speaking monitoring system 112 depicted in FIG. 1 along with external modules performs necessary measurements of pixels for use in the compensation methods described below.

Figure 2:
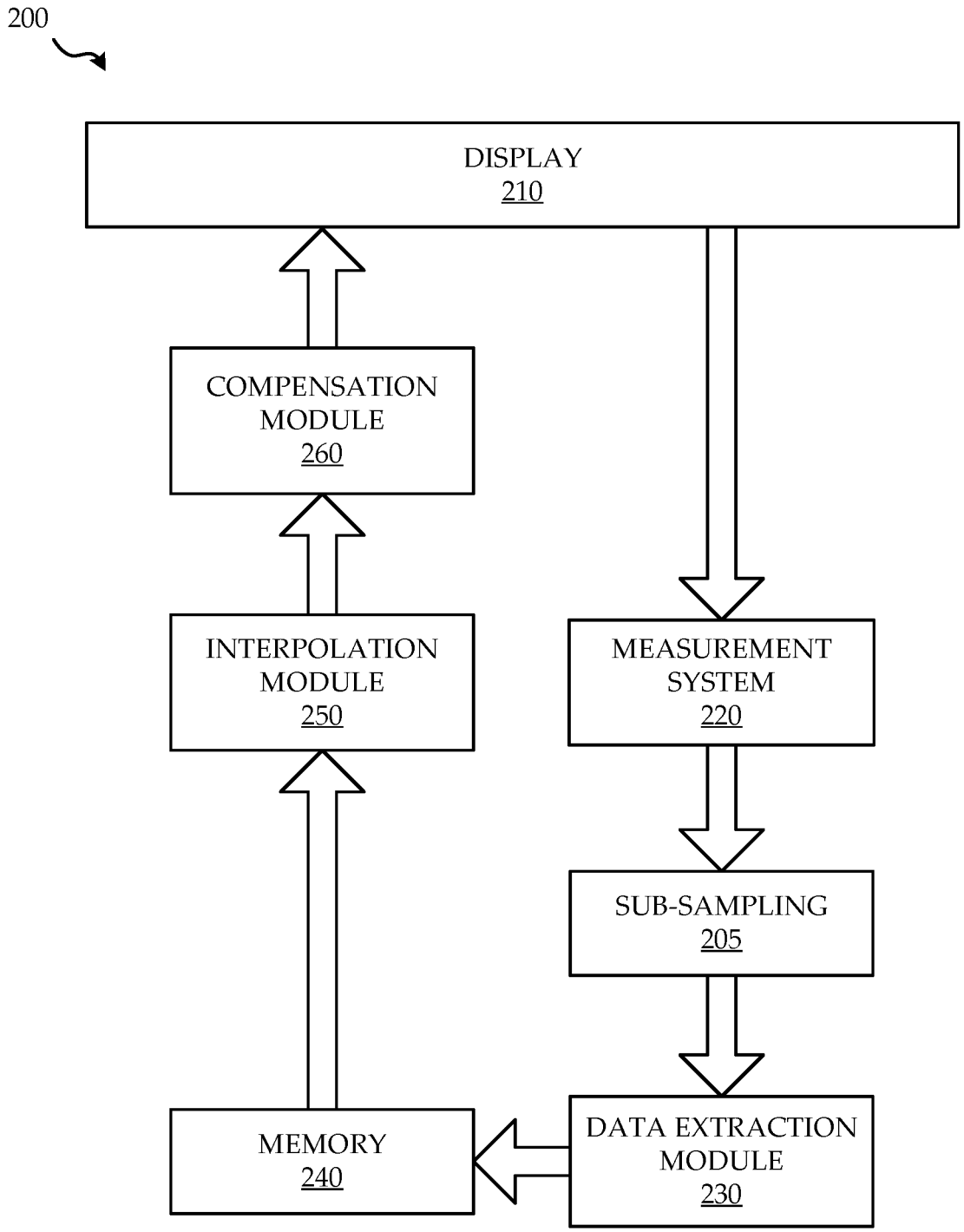
FIG. 2 is a system block diagram of reduced bandwidth compensation system and method in which data is sub-sampled prior to storage.

Referring to FIG. 2, a compensation system 200 according to an embodiment will now be described.

The compensation system 200 includes a display system 210 which is being calibrated and a measurement system 220 which may comprise the monitoring system 112 described above and may include optical sensors or any other or elements for measuring characteristics of the pixels of the display for use in deriving calibration data. Sub-sampling 205, the data extraction module 230, the interpolation module 250 and the compensation module 260 may be implemented in the controller 102 or data driver 104 of FIG. 1 or may be implemented in separate modules. In another case, sub-sampling 205, the data extraction module 230, and the interpolation module 250 can be part of the display system, for example, integrated in a timing controller TCON. The display system 210 of FIG. 2 may correspond more or less to the display system 150 of FIG. 1 and includes similar components thereof which for convenience are not shown in FIG. 2. The memory 240 may correspond to memory 106 of FIG. 1.

The measurement system 220 is arranged to measure or monitor the luminance of pixels 110 of the display panel 220 and/or other characteristics such as current and voltage of various circuit elements of the pixels 110 of the display panel 210, which measurements are utilized by the compensation module for correcting the image produced by the display as described above.

FIG. 2 shows an embodiment and method of compensation including sub-sampling measured data for which only the sub-sampled data is stored in memory 240. In one embodiment, the measurement system 220 takes measurements of the entire array of pixels 110 in the display 120 at full spatial resolution and the measured data is thereafter spatially sub-sampled by sub-sampling 205. In other words, sub-sampling 205 and data extraction module 230 serve to extract the measurement data, only for a selected subset of all the pixels of the display 210 at partial spatial resolution, from a full set of measurement data measured by the measurements system 220 and store it in memory 240. In such an embodiment, sub-sampling 205 may form part of the data extraction module 230 or may be a separate module. Spatial sub-sampling generally utilizes a technique of sampling the data, either during measurement or as described below of data retrieval, of only a fraction of pixels of a group of pixels, and generating the data for the unsampled rest of the pixels from an interpolation of data from the sampled pixels.

In some embodiments, the measurement system 220 takes measurements only of the selected subset of pixels in the array. As such, in those embodiments the measurement system 220 and sub-sampling 205 are performed simultaneously. In such an embodiment, the measurement system 220 itself performs sub-sampling 205 of measurements or sub-sampling 205 may be a separate module which cooperates with the measurement system 220 while measurements are taken. As with the embodiment described above, only measurement data for a subset of pixels is stored in memory 240.

After the measurement data has been extracted by the data extraction module 230 and the extracted information has been stored in the memory 240, only the measurement data for the subset of the pixels of the display, is passed to interpolation module 250 which utilizes an interpolation algorithm to create a full spatial resolution data set from the subset of measurement data. It follows that the sub-sampling 205, performed during measurement or performed after measurement of all of the pixels, is performed by selecting an appropriate i.e. a suitable selected subset of pixels of the display for use in deriving data for all the pixels of the display. For example, a small contiguous rectangle of pixels in only one part of the entire display would be less effective to compensate the entire display than subsampling a regular distribution of sparse pixels throughout the display area. As such, in the contemplated embodiments the particular pixels from which data is sub-sampled are predetermined either with a fixed pattern or algorithmically determined according to certain criteria. Whatever the specific subset of pixels, due to the reduction in data retrieved from memory 240 from a full spatial resolution data set to measurement data for only that subset of pixels at partial resolution, bandwidth between the memory 240 and the compensation module 260 is reduced. It should be noted that the bandwidth savings are obtained between the memory 240 and the interpolation module 250 which retrieves the measurement data and performs the interpolation for the compensation module 260, and the interpolation module 250 therefore is typically local to the compensation module 260.

Once interpolated, the full spatial resolution measurement data are used by the compensation module 260 in cooperation with the other elements of the display system, for compensating the issues related with said display array as described above in association with FIG. 1.

For the above embodiments, it is noted that after measurement and subsequent storing of the measurement data in memory 240 the subset of selected pixels is fixed and it is hard to change the set of selected subset of pixels for better interpolation. Since only the measurement data for the subset of pixels are present in the memory 240, determining how to better sub-sample the pixels with the measurement system is difficult as not all of the relevant information is available.

Figure 3:
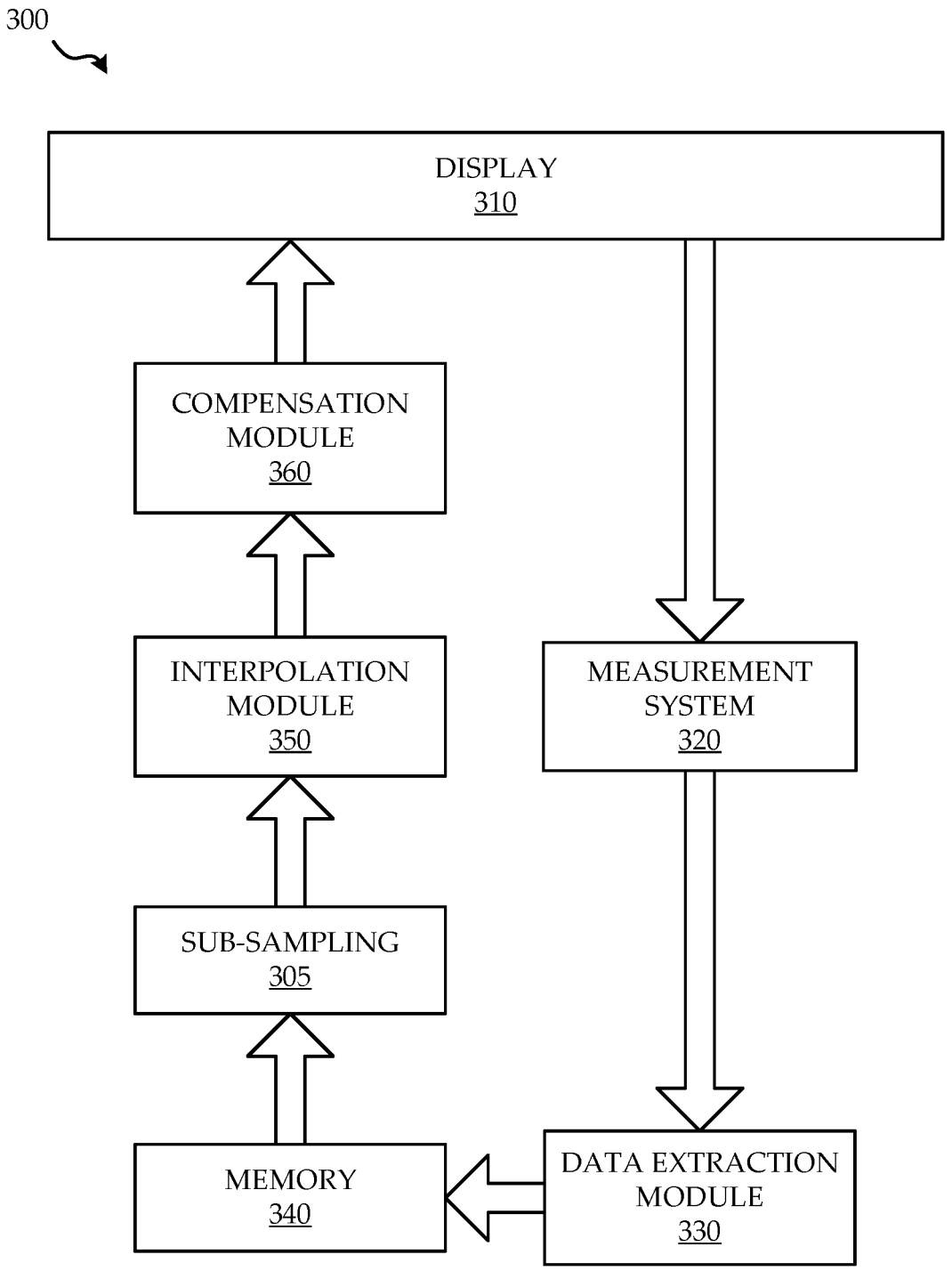
FIG. 3 is a system block diagram of reduced bandwidth compensation system and method in which data is sub-sampled after storage.

Referring also to FIG. 3, an embodiment and method of compensation including sub-sampling measured data for which measurement data for the entire display array is stored in memory, will now be described.

In the embodiment of FIG. 3, the measurement data stored in the memory 340 has the full spatial resolution of the array structure. The measurement system 320 takes measurements of the entire array of pixels in the display at full spatial resolution and data extraction module 330 extracts the full spatial resolution measurement data and stores it in memory 340.

Although full spatial resolution measurement data is stored in memory 340, only a subset of the data or partial resolution measurement data is fetched from the memory 340 by sub-sampling 305 and provided to interpolation module 350 each time data is provided to interpolation module 350 to create the full resolution data utilized by the compensation module 360. In this embodiment, sub-sampling may form part of interpolation module 350 or may be a separate module which provides the sub-sampled data to the interpolation module 350. In the embodiment of FIG. 3, because the full resolution measurement data are stored in memory 340, it can be analyzed, and measurement data from different sets of pixels may be selected to improve the interpolation output. In some embodiments this is achieved by averaging the error for each pixel. In other embodiments, because the specific algorithm used for interpolation is known, the set of selected pixels may be determined by choosing the set of pixels which optimizes, i.e., minimizes or otherwise reduces the error between the predicted interpolated data and the actual data stored in the memory 340. Whatever the specific subset of pixels, due to the reduction in data retrieved from memory 340 from a full spatial resolution data set to measurement data for only a subset of pixels at partial resolution, bandwidth between the memory 340 and the compensation and interpolation modules 350, 360 is reduced.

Figure 4:
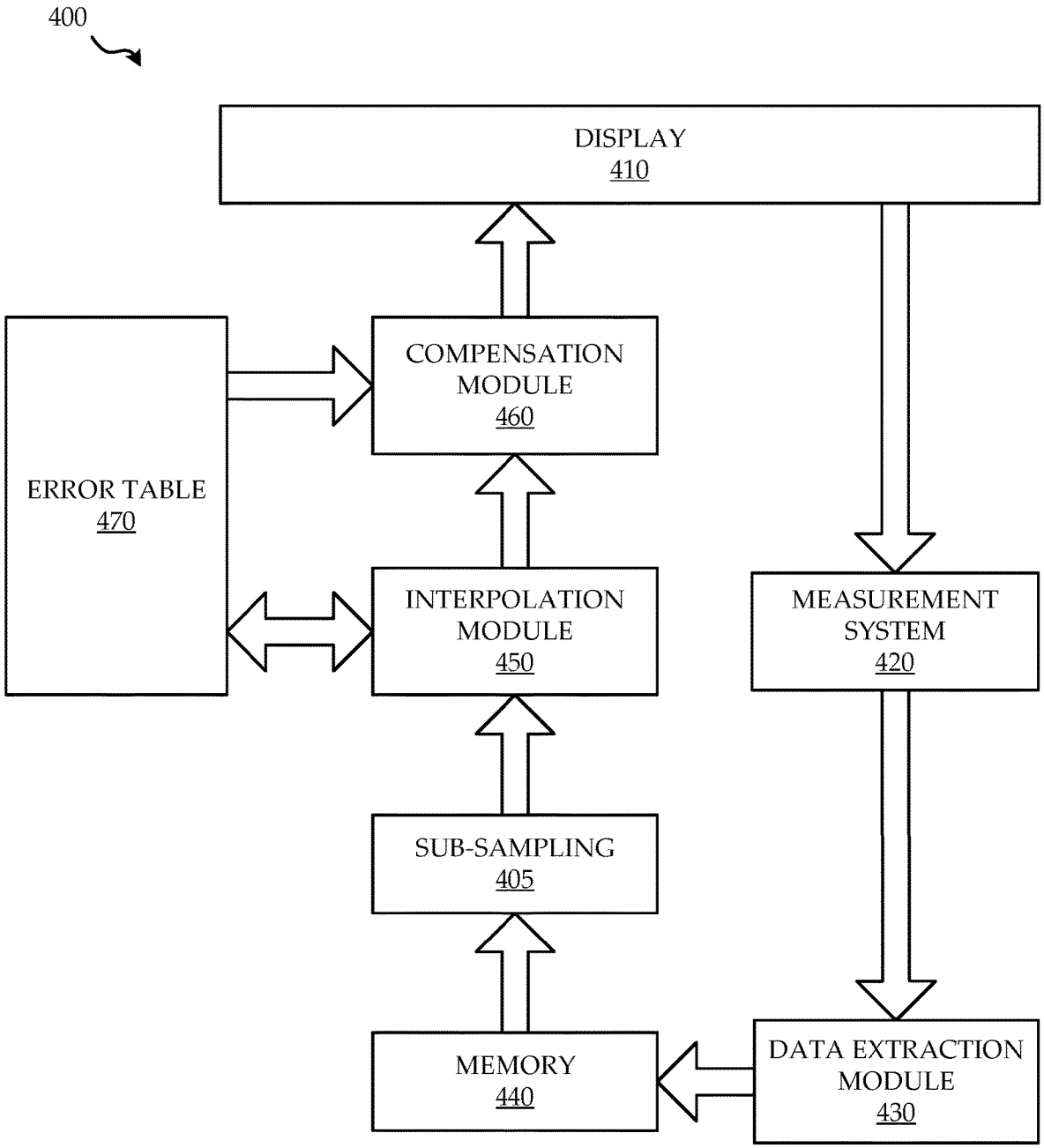
FIG. 4 is a system block diagram of reduced bandwidth compensation system and method which utilizes an error table.

Referring now also to FIG. 4, an embodiment which utilizes an error table 470 to store the measurement data of pixels with predicted interpolation errors larger than a given threshold will now be described.

As with the embodiment depicted in FIG. 3, the measurement system 420 takes measurements of the entire array of pixels in the display at full spatial resolution and data extraction module 430 extracts the full spatial resolution measurement data and stores it in memory 440.

Although full spatial resolution measurement data is stored in memory 440, only a subset of the data is fetched from the memory 440 by sub-sampling 405 and provided to interpolation module 450 each time data is provided to interpolation module 450 to create the full resolution data utilized by the compensation module 460.

Interpolation module 450 or a separate module, compares the predicted interpolated data with the full spatial resolution measurement data stored in the memory 440, determines the error of the interpolated data and generates a predicted interpolation error for each pixel. Those pixels which have predicted errors in predicted interpolated data which exceed a threshold are identified and interpolation correction data capable of being used to correct the interpolated data is stored in the error table 470 for those pixels.

In the embodiment of FIG. 4, the compensation module 460 obtains measurement data for pixels whose interpolation errors fall below the threshold directly from the interpolation module 450 as in the embodiments described above, and obtains interpolation correction data for those pixels identified as having interpolation errors larger than the threshold only from the error table 470 itself or obtains interpolation correction data from the error table 470 and interpolation data from the interpolation module 450. In a case where the compensation module 460 retrieves for a pixel the interpolation correction data only from the error table 470, the interpolation correction data stored in the error table 470 corresponds to the correct or absolute measurement data for that pixel and is used by the compensation module 460 as a replacement for the interpolated data. In a case where the compensation module 460 retrieves for a pixel interpolation correction data from the error table 470 and interpolation data from the interpolation module 450, the interpolation correction data stored in the error table 470 corresponds to the predicted error in the interpolated measurement data for that pixel and is used by the compensation module 460 along with the interpolation data received from the interpolation module 450 to calculate the correct or absolute measurement data for generating compensation data.

As with the embodiments described in association with FIG. 2 and FIG. 3, embodiments utilizing an error table 470, due to the reduction in data retrieved from memory 440 from a full spatial resolution data set to measurement data for only a subset of pixels at partial resolution, also benefit from a reduction in bandwidth between the memory 440 and the compensation and interpolation modules 460, 450. The extra transfer of data caused by usage of the error table minimally only applies to those pixels with high interpolation errors and advantageously corrects measurement data for those problematic pixels.

In some embodiments, during compensation, the data is fetched from the error table 470 by the interpolation module 450 and sent to the compensation module 460, while in other embodiments, the data is fetched from the error table 470 by compensation module 460.

Although FIG. 4 depicts the error table used in an embodiment similar to that depicted in FIG. 3, namely one for which the sub-sampling 305 is performed while fetching data from the memory 340 and prior to providing it to the interpolation module 350, the error table 470 may equally be utilized for an embodiment similar to that depicted in FIG. 2, for which only a subset of measurement data is stored in memory 240.

In some variations of any of the embodiments described above, the data is divided into low spatial frequency and high spatial frequency. The low spatial frequency data is thus sub-sampled at lower pixel resolution and the higher spatial frequency content is sub-sampled at a higher pixel resolution. As such the sub-sampling 205, 305, 405 occurs at two scales and the memory 240, 340, 440 stores two sets of subsets of pixels, one appropriate for reproducing the low spatial frequency component through interpolation, and one appropriate for reproducing the high spatial frequency component through interpolation. The interpolation module 250 creates the low frequency and high frequency content and from those data sets and recreates accurate content for each pixel. In some embodiments, the different sets of data may be stored in different memory based on the sub-sampling frequency. As described herein above, optimization or minimization of error of the measurements of the selected subsets of the pixels for use in interpolation is possible, and providing such optimization at two different scales of resolution can further improve the resulting optimization.

In some embodiments, the sub-sampling frequency and or pattern can be set by a user or by the system. In one embodiment, sub-sampling spatial frequency or pattern can be decreased for some content for which the compensation is not critical. In another example, for saving power, the system may decide to reduce the sub-sampling frequency.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method for compensating an image produced by an emissive display system comprising an array of pixels, each pixel including a light-emitting device, the method comprising:

storing full resolution measurement data of the array of pixels in a memory;

retrieving select measurement data from the memory only for a selected subset of pixels of the display;

interpolating the select measurement data from the selected subset of pixels for generating interpolated measurement data for each pixel of the display; and compensating the display using the interpolated measurement data;

utilizing an error table including interpolation correction data for problematic pixels in which a predicted pixel interpolation error exceeds a threshold, wherein the predicted pixel interpolation error is generated from a comparison of interpolated pixel data of said interpolated measurement data with corresponding actual pixel data of the full resolution measurement data;

wherein the selected subset of pixels is predetermined based on minimizing error between the interpolated measurement data and the full resolution measurement data stored in the memory.

2. The method according to claim 1, wherein the selected subset of pixels is predetermined utilizing an algorithm used for interpolating the select measurement data to determine the selected subset of pixels which minimize error between the interpolated measurement data and the full resolution measurement data.

3. The method according to claim 1, wherein the selected subset of pixels is predetermined by averaging error for each pixel to determine the selected subset of pixels which minimize error between the interpolated measurement data and the full resolution measurement data.

4. The method according to claim 1, further comprising:

comparing the interpolated pixel data with corresponding pixel data of said full resolution measurement data generating the predicted pixel interpolation error; and storing the interpolation correction data for the problematic pixels in the error table for the problematic pixels where said predicted pixel interpolation error exceeds the threshold.

5. The method according to claim 4, further comprising generating absolute measurement data for the problematic pixels by replacing interpolated pixel data with the interpolation correction data.

6. The method according to claim 5, wherein the interpolation correction data comprises the corresponding actual pixel data.

7. The method according to claim 4, further comprising generating absolute measurement data for the problematic pixels by replacing the interpolated pixel data with the interpolated pixel data in addition to the interpolation correction data, which comprises a predicted error.

8. The method according to claim 1, further comprising:

measuring characteristics of substantially all of the array of pixels generating the full resolution measurement data for use in compensation of the display system.

9. A method for compensating an image produced by an emissive display system comprising an array of pixels, each pixel including a light-emitting device, the method comprising:

storing full resolution measurement data of the array of pixels in a memory;

retrieving select measurement data from the memory only for a selected subset of pixels of the display;

interpolating the select measurement data from the selected subset of pixels for generating interpolated measurement data for each pixel of the display; and compensating the display using the interpolated measurement data;

wherein the selected subset of pixels is predetermined based on minimizing error between the interpolated measurement data and the full resolution measurement data stored in the memory;

wherein storing the full resolution measurement data in the memory comprises storing low spatial frequency measurement data and high spatial frequency measurement data in the memory;

wherein retrieving the select measurement data from the full resolution measurement data stored in the memory comprises retrieving select low spatial frequency measurement data from the low spatial frequency measurement data stored in the memory, and retrieving select high spatial frequency measurement data from the high spatial frequency measurement data stored in the memory, and wherein interpolating the select measurement data comprises: interpolating the select low spatial frequency measurement data and interpolating the select high spatial frequency measurement data, and combining the interpolated low spatial frequency measurement data and the interpolated high spatial frequency measurement data together generating the interpolated measurement data.

10. The method according to claim 9, further comprising:

utilizing an error table including interpolation correction data for problematic pixels in which a predicted pixel interpolation error exceeds a threshold, wherein the predicted pixel interpolation error is generated from a comparison of interpolated pixel data of said interpolated measurement data with corresponding actual pixel data of the full resolution measurement data.

11. A system for compensating an image produced by an emissive display system comprising an array of pixels, each pixel including a light-emitting device, the system comprising:

a display comprising the array of pixels;

a memory including characteristics of substantially all of the array of pixels comprising full resolution measurement data;

an interpolation module capable of retrieving selected measurement data from only a selected subset of pixels of the display stored in the memory, and interpolating the selected measurement data generating interpolated measurement data for each pixel of the display;

a compensation module for compensating the display with use of the interpolated measurement data for each pixel;

a sub-sampling module configured to predetermine the selected subset of pixels based on minimizing error between the interpolated measurement data and the full resolution measurement data stored in the memory; and an error table including interpolation correction data for problematic pixels in which a predicted pixel interpolation error exceeds a threshold, wherein the predicted pixel interpolation error is generated from a comparison of interpolated pixel data of said interpolated measurement data with corresponding actual pixel data of the full resolution measurement data;

wherein the compensation module compensates the display with use of the interpolated measurement data and the interpolation correction data.

12. The system according to claim 11, wherein the sub-sampling module is configured to predetermine the selected subset of pixels utilizing an algorithm used for interpolating the selected measurement data to determine the selected subset of pixels which minimize error between the interpolated measurement data and the full resolution measurement data.

13. The system according to claim 11, wherein the sub-sampling module is configured to predetermine the selected subset of pixels by averaging error for each pixel to determine the selected subset of pixels which minimize error between the interpolated measurement data and the full resolution measurement data.

14. The system according to claim 11, wherein the interpolation module is also configured to: compare the interpolated pixel data with the corresponding pixel data of said full measurement data generating the predicted pixel interpolation error; and for the problematic pixels in which the predicted pixel interpolation error exceeds the threshold, store interpolation correction data for the problematic pixels in the error table.

15. The system according to claim 14, wherein the interpolation module is also configured to generate absolute measurement data for the problematic pixels by replacing interpolated pixel data with the interpolation correction data.

16. The system according to claim 15, wherein the interpolation correction data comprises the corresponding actual pixel data.

17. The system according to claim 14, wherein the interpolation module is also configured to generate absolute measurement data for the problematic pixels by replacing interpolated pixel data with the corresponding interpolated pixel data in addition to the interpolation correction data, which comprises a predicted error.

18. The system according to claim 11, further comprising a monitoring system coupled to the array of pixels for measuring characteristics of substantially all of the array of pixels generating the full resolution measurement data.

19. A system for compensating an image produced by an emissive display system comprising an array of pixels, each pixel including a light-emitting device, the system comprising:

a display comprising the array of pixels;

a memory including characteristics of substantially all of the array of pixels comprising full resolution measurement data;

an interpolation module capable of retrieving selected measurement data from only a selected subset of pixels of the display stored in the memory, and interpolating the selected measurement data generating interpolated measurement data for each pixel of the display;

a compensation module for compensating the display with use of the interpolated measurement data for each pixel; and a sub-sampling module configured to predetermine the selected subset of pixels based on minimizing error between the interpolated measurement data and the full resolution measurement data stored in the memory;

wherein the full resolution measurement data in the memory comprises: low spatial frequency measurement data, and high spatial frequency measurement data;

wherein the interpolation module is configured to retrieve the select measurement data from the memory comprising: select low spatial frequency measurement data from the low spatial frequency measurement data, and select high spatial frequency measurement data from the high spatial frequency measurement data, and wherein the interpolation module is configured to interpolate the select low spatial frequency measurement data and interpolate the select high spatial frequency measurement data, and combining interpolated low spatial frequency measurement data and interpolated high spatial frequency measurement data together generating the interpolated measurement data for every pixel.

20. The system according to claim 19, further comprising an error table including interpolation correction data for problematic pixels in which a predicted pixel interpolation error exceeds a threshold, wherein the predicted pixel interpolation error is generated from a comparison of interpolated pixel data of said interpolated measurement data with corresponding actual pixel data of the full resolution measurement data;

wherein the compensation module compensates the display with use of the interpolated measurement data and the interpolation correction data.

* * * * *